US009530601B2

(12) United States Patent
Alcantara Gonzalez et al.

(10) Patent No.: US 9,530,601 B2
(45) Date of Patent: Dec. 27, 2016

(54) THERMO MAGNETIC TRIP UNIT FOR A CIRCUIT BREAKER AND CIRCUIT BREAKER

(71) Applicant: SIEMENS AKTIENGESELLSCHAFT, Munich (DE)

(72) Inventors: Raymundo Alcantara Gonzalez, Escobedo (MX); Alethya Deydree Salas Armendariz, Escobedo (MX)

(73) Assignee: SIEMENS AKTIENGESELLSCHAFT, Munich (DE)

( * ) Notice: Subject to any disclaimer, the term of this patent is extended or adjusted under 35 U.S.C. 154(b) by 228 days.

(21) Appl. No.: 14/079,685

(22) Filed: Nov. 14, 2013

(65) Prior Publication Data

US 2014/0232510 A1 Aug. 21, 2014

(30) Foreign Application Priority Data

Feb. 20, 2013 (EP) ..... 13156017

(51) Int. Cl.
*H01H 61/02* (2006.01)
*H01H 5/18* (2006.01)
*H01H 71/16* (2006.01)

(52) U.S. Cl.
CPC ..... *H01H 61/02* (2013.01); *H01H 5/18* (2013.01); *H01H 71/164* (2013.01)

(58) Field of Classification Search
CPC ..... H01H 77/04; H01H 71/16; H01H 71/323; H01H 71/40; H01H 71/164
USPC ..... 337/37, 70, 73, 55
See application file for complete search history.

(56) References Cited

U.S. PATENT DOCUMENTS 2,175,859 A * 10/1939 Tusing ..... H01H 71/16 335/35
2,573,307 A * 10/1951 Casey ..... H01H 71/7436 200/286
2,740,864 A * 4/1956 Tsai ..... H01H 37/12 337/375
2,795,670 A * 6/1957 Cellerini ..... H01H 71/162 335/22

(Continued)

FOREIGN PATENT DOCUMENTS

WO WO 2012037991 A1 3/2012

*Primary Examiner* — Anatoly Vortman
(74) *Attorney, Agent, or Firm* — Harness, Dickey & Pierce, P.L.C.

(57) ABSTRACT

A thermo magnetic trip unit is disclosed for a circuit breaker, in particular for a molded case circuit breaker. In an embodiment, the thermo magnetic trip unit includes a braid plate, a load plate and a heater arranged between the braid plate and the load plate, whereby the braid plate, the load plate and the heater form a current path. In an embodiment, the thermo magnetic trip unit further includes a bimetal positioned on the heater, a rotatable trip bar and an energy storage spring, whereby the trip bar can release the energy storage spring after being touched by the bimetal with certain power. Further, the bimetal is an arched or curved snap action bimetal which snaps over to an opposite direction as soon as a certain temperature is reached. Further, a circuit breaker, in particular molded case circuit breaker, including such thermo magnetic trip unit, is disclosed.

10 Claims, 4 Drawing Sheets

(56) References Cited

U.S. PATENT DOCUMENTS

Figure 6:
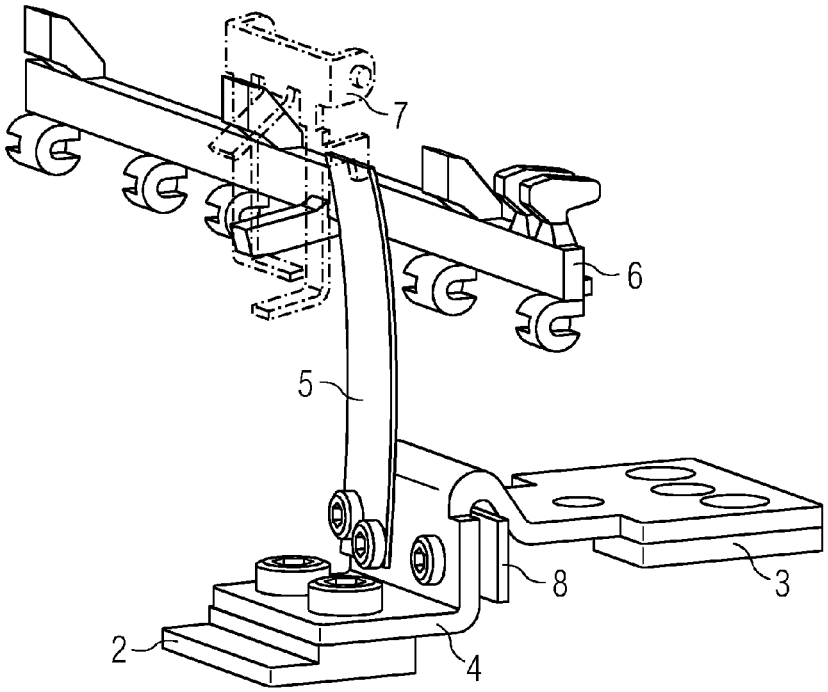

| | | | | | |
|---|---|---|---|---|---|
| 2,813,167 | A * | 11/1957 | Bingenheimer | H01H 71/405 | 335/145 |
| 3,258,560 | A * | 6/1966 | Jencks | H01H 71/40 | 335/173 |
| 3,260,825 | A * | 7/1966 | Owen | H01H 71/162 | 337/102 |
| 3,309,637 | A | 3/1967 | Jencks | | |
| 3,336,545 | A * | 8/1967 | Stokes | H01H 71/40 | 335/41 |
| 4,695,814 | A * | 9/1987 | Matsumoto Yoshiaki | H01H 71/164 | 335/43 |
| 5,317,471 | A * | 5/1994 | Izoard | H01H 69/01 | 324/417 |
| 5,329,264 | A * | 7/1994 | Toda | H01H 71/405 | 335/35 |
| 6,803,850 | B2 * | 10/2004 | Richter | H01H 71/164 | 335/35 |
| 7,518,482 | B2 * | 4/2009 | Fleege | H01H 71/16 | 337/36 |
| 2004/0150504 | A1 * | 8/2004 | Nicholson | H01H 37/58 | 337/54 |

* cited by examiner

FIG 1 State of the art:
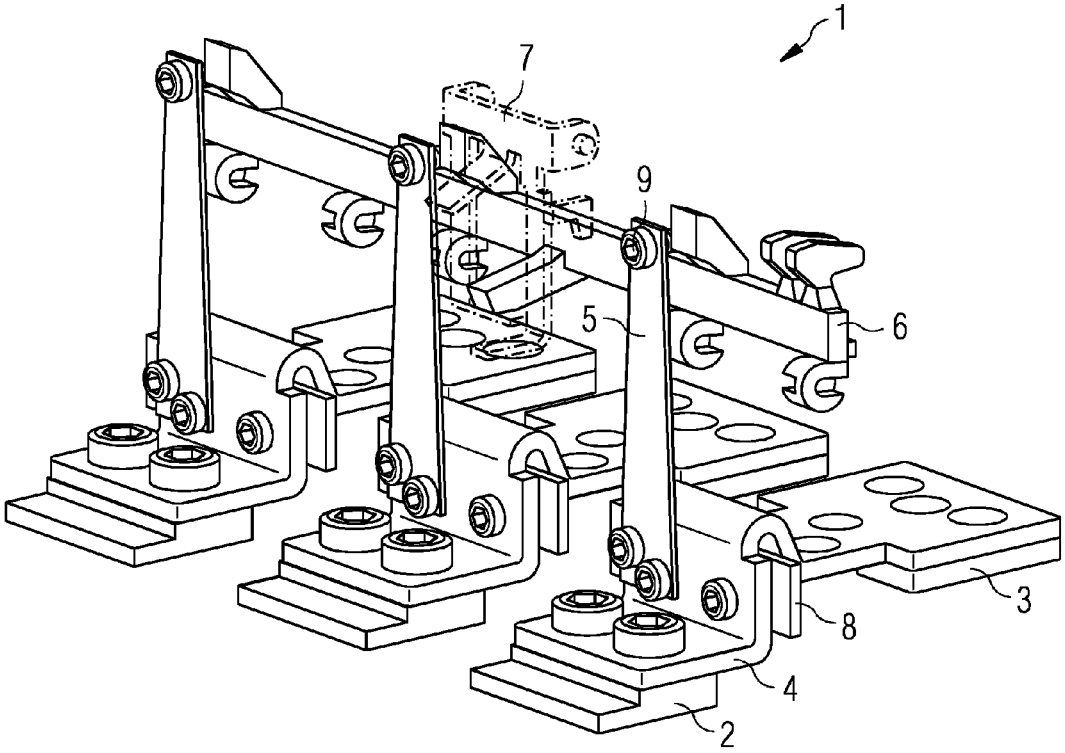

FIG 2 State of the art:
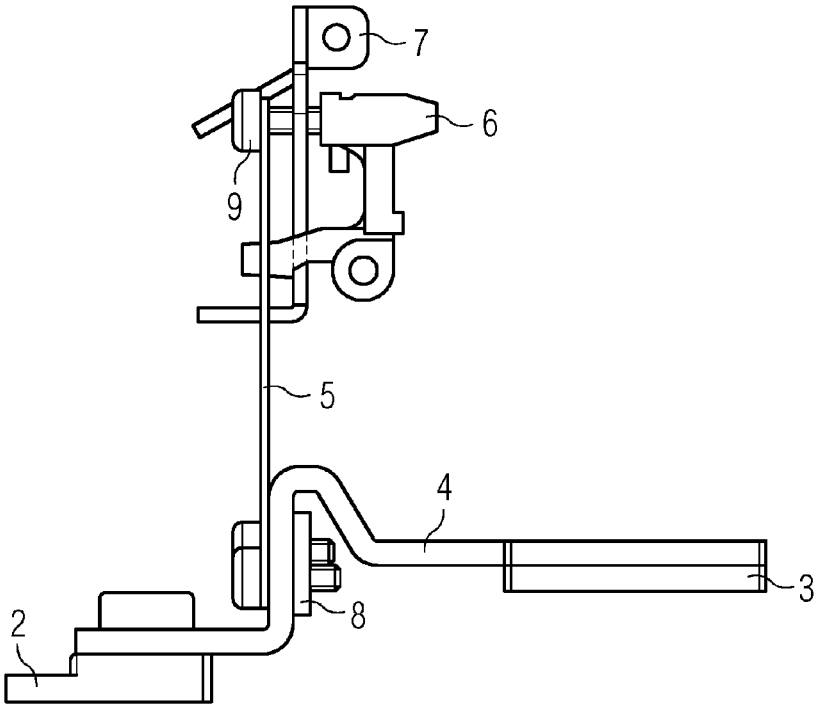
FIG 3 State of the art:
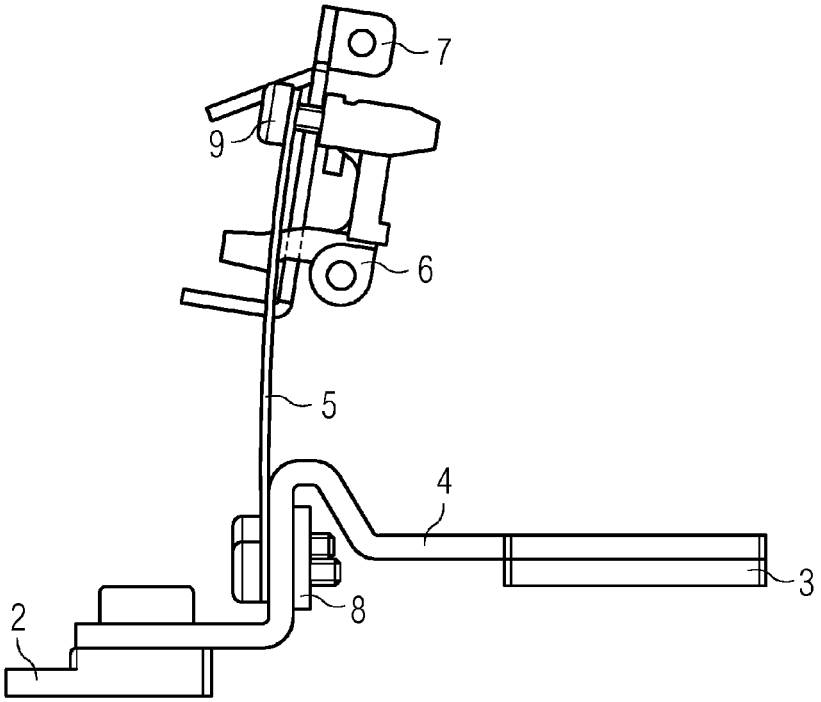

FIG 4 State of the art:
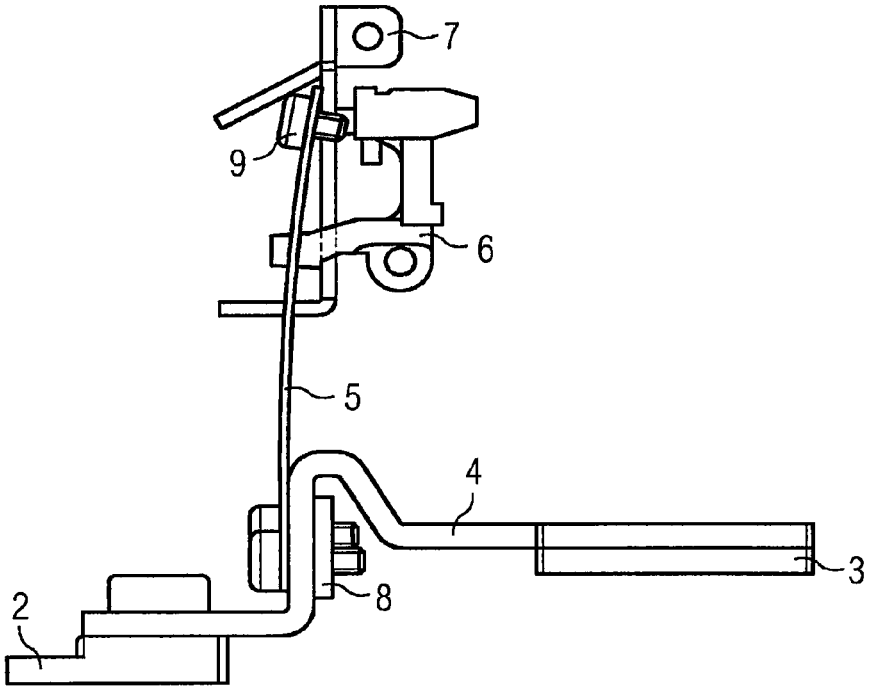
FIG 5
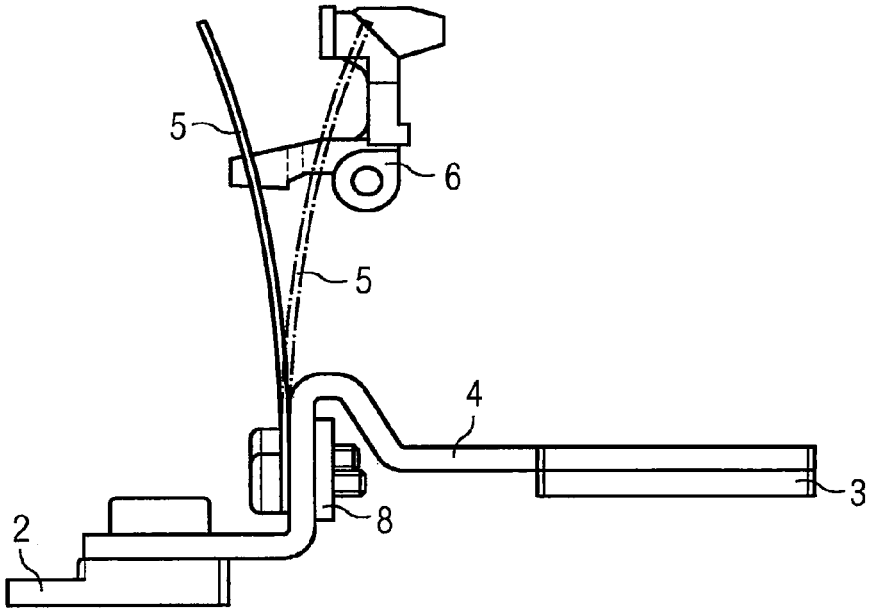

THERMO MAGNETIC TRIP UNIT FOR A CIRCUIT BREAKER AND CIRCUIT BREAKER

PRIORITY STATEMENT

The present application hereby claims priority under 35 U.S.C. §119 to European patent application number EP 13156017.9 filed Feb. 20, 2013, the entire contents of which are hereby incorporated herein by reference.

FIELD

At least one embodiment of the invention generally relates to a thermo magnetic trip unit for a circuit breaker. In particular, it relates to a thermo magnetic trip unit for a molded case circuit breaker, comprising a braid plate, a load plate and a heater arranged between the braid plate and the load plate, whereby the braid plate, the load plate and the heater form a current path, further comprising a bimetal positioned on the heater, a rotatable trip bar and an energy storage spring, whereby the trip bar can release the energy storage spring after being touched by the bimetal with certain power. Further, at least one embodiment of the invention generally relates to a circuit breaker, in particular a molded case circuit breaker, comprising at least one thermo magnetic trip unit.

BACKGROUND

A circuit breaker is an automatically operated electrical switch designed to protect an electrical circuit from damage caused by overload or short circuit. A circuit breaker automatically has to open its contacts if an overcurrent condition is sensed. Therefore, a circuit breaker comprises a trip unit which determines when the contacts have to open.

Some circuit breakers comprise a thermo magnetic trip unit. The thermo magnetic trip unit includes elements designed to sense the heat resulting from an overload condition and the high current resulting from a short circuit. In addition, some circuit breakers incorporate a "push to trip" button.

It is possible that a temperature profile of a thermo magnetic trip unit of a standard circuit breaker does not meet the requirements of each circuit breaker. For example, increasing the temperature inside the thermo magnetic trip unit of a first circuit breaker can generate higher temperatures on the lugs that do not comply with temperatures on the lugs of standard circuit breakers.

A low temperature profile can generate low temperatures in the bimetal of a thermo magnetic trip unit which result in a low bimetal deflection and a low power development of the bimetal. Although the deflection of the bimetal can be compensated by using a calibration screw to get the bimetal closer to the trip bar of the thermo magnetic trip unit, the temperature may not be enough for the bimetal to produce enough power to rotate the trip bar and release the energy storage spring "kicker" of the thermo magnetic trip unit.

For example, familiar circuit breakers comprise a thermo magnetic trip unit 1 with braid plate 2, a load plate 3, a heater 4 and a bimetal 5 which has an indirect heating through the heater 4. The bimetal 5 can be screwed to the heater 4 and/or a heater support plate 8. A trip bar 6 of the thermo magnetic trip unit 1 rotates as soon as it is moved by the bimetal 5. The trip bar 6 can release the energy storage spring 7 of the thermo magnetic trip unit 7 to open the contacts of the circuit breaker. A thermal calibration screw 9 can be used to calibrate the thermo magnetic trip unit 1 to increase or decrease the time the bimetal 5 needs to touch the trip bar 6, see FIGS. 1 to 4.

FIG. 2 shows a familiar thermo magnetic trip unit 1 with a bimetal 5 in its normal position. If no current is flowing through the current path of the thermo magnetic trip unit 1, the bimetal 5 is in a straight "normal" position.

If sufficient overcurrent flows through the circuit breaker's current path, heat build-up causes the bimetal 5 of the thermo magnetic trip unit 1 to bend. As the bimetal 5 is heated, it bends from its high expansion side to its low expansion side. After bending a predetermined distance, the bimetal 5 touches the trip bar 6 activating the energy storage spring 7 and thus the trip mechanism of circuit breaker. If 120% of the breaker nominal current flows through the current path, the bimetal 5 generates power according to the available temperature which rotates the thermal trip bar 6 and releases the energy storage spring 7, see FIG. 3.

If the temperature is not enough, the bimetal 5 may bend and touch the trip bar 6, but it won't generate enough power to rotate the trip bar 6, see FIG. 4. If 100% of the current flows through the current path of the thermo magnetic trip unit 1 the bimetal 5 can bend but can fail to touch the trip bar 6.

SUMMARY

At least one embodiment of the present invention is directed to a thermo magnetic trip unit of a circuit breaker, at least partially. A thermo magnetic trip unit of a circuit breaker, in particular of a molded case circuit breaker, and a circuit breaker, in particular a molded case circuit breaker, are disclosed which overcome, at least partially, at least one of the disadvantages of the afore-mentioned thermo magnetic trip unit, to always generate enough power to move the trip bar of the thermo magnetic trip unit.

Further features and details of the present invention result from the sub claims, the description and the drawings. Features and details discussed with respect to the thermo magnetic trip unit can also be applied to circuit breaker and vice versa.

According to a first embodiment of the invention, a thermo magnetic trip unit for a circuit breaker, in particular for a molded case circuit breaker, comprises a braid plate, a load plate and a heater arranged between the braid plate and the load plate. The braid plate, the load plate and the heater of the thermo magnetic trip unit are building a current path. The thermo magnetic trip unit further comprises a bimetal positioned on the heater, a rotatable trip bar and an energy storage spring. The trip bar can release the energy storage spring after being touched by the bimetal with a certain power. In an embodiment of the thermo magnetic trip unit, the bimetal is an arched or curved snap action bimetal which snaps over to an opposite direction as soon as a certain temperature is reached, whereby the temperature depends on the nominal current flowing to the current path of the thermo magnetic trip unit and whereby the snap action bimetal is formed in such way that in a normal position the snap action bimetal is bent away from the trip bar.

According to a second embodiment of the invention, a circuit breaker, in particular a molded case circuit breaker, comprises at least one thermo magnetic trip unit according to an embodiment of the invention. In at least one embodiment, such a circuit breaker ensures that the electric contacts always open if a sufficient overcurrent flows through the circuit breaker's current path. The snap action bimetal guaranties that the power to rotate the trip bar is always high enough if a certain amount of temperature and nominal current is reached.

BRIEF DESCRIPTION OF THE ACCOMPANYING DRAWINGS

Figure 7:
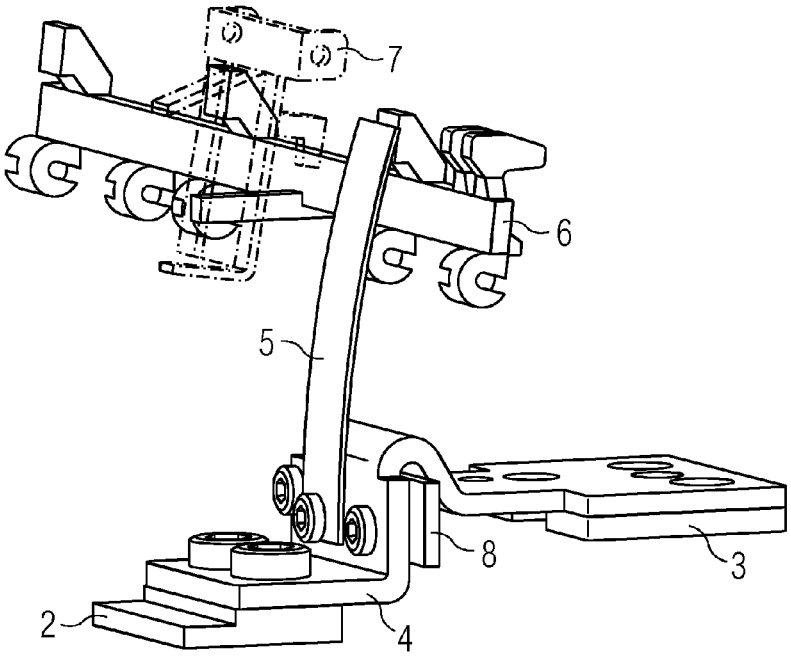

The present invention is further described with respect to the accompanying figures. It is shown schematically in:

FIG. 1 in a perspective view a thermo magnetic trip unit according to the conventional state of the art, FIG. 2 in a side view a thermo magnetic trip unit according to the conventional the state of the art, FIG. 3 in a side view a thermo magnetic trip unit according to the conventional the state of the art, FIG. 4 in a side view a thermo magnetic trip unit according to the conventional the state of the art, FIG. 5 in a side view a thermo magnetic trip unit according to an embodiment of the invention, FIG. 6 in a perspective view a thermo magnetic trip unit with a bimetal in its normal position according to an embodiment of the invention and FIG. 7 in a perspective view a thermo magnetic trip unit with a snapped bimetal according to an embodiment of the invention.

DETAILED DESCRIPTION OF THE EXAMPLE EMBODIMENTS

The present invention will be further described in detail in conjunction with the accompanying drawings and embodiments. It should be understood that the particular embodiments described herein are only used to illustrate the present invention but not to limit the present invention.

Accordingly, while example embodiments of the invention are capable of various modifications and alternative forms, embodiments thereof are shown by way of example in the drawings and will herein be described in detail. It should be understood, however, that there is no intent to limit example embodiments of the present invention to the particular forms disclosed. On the contrary, example embodiments are to cover all modifications, equivalents, and alternatives falling within the scope of the invention. Like numbers refer to like elements throughout the description of the figures.

Specific structural and functional details disclosed herein are merely representative for purposes of describing example embodiments of the present invention. This invention may, however, be embodied in many alternate forms and should not be construed as limited to only the embodiments set forth herein.

It will be understood that, although the terms first, second, etc. may be used herein to describe various elements, these elements should not be limited by these terms. These terms are only used to distinguish one element from another. For example, a first element could be termed a second element, and, similarly, a second element could be termed a first element, without departing from the scope of example embodiments of the present invention. As used herein, the term "and/or," includes any and all combinations of one or more of the associated listed items.

It will be understood that when an element is referred to as being "connected," or "coupled," to another element, it can be directly connected or coupled to the other element or intervening elements may be present. In contrast, when an element is referred to as being "directly connected," or "directly coupled," to another element, there are no intervening elements present. Other words used to describe the relationship between elements should be interpreted in a like fashion (e.g., "between," versus "directly between," "adjacent," versus "directly adjacent," etc.).

The terminology used herein is for the purpose of describing particular embodiments only and is not intended to be limiting of example embodiments of the invention. As used herein, the singular forms "a," "an," and "the," are intended to include the plural forms as well, unless the context clearly indicates otherwise. As used herein, the terms "and/or" and "at least one of" include any and all combinations of one or more of the associated listed items. It will be further understood that the terms "comprises," "comprising," "includes," and/or "including," when used herein, specify the presence of stated features, integers, steps, operations, elements, and/or components, but do not preclude the presence or addition of one or more other features, integers, steps, operations, elements, components, and/or groups thereof.

It should also be noted that in some alternative implementations, the functions/acts noted may occur out of the order noted in the figures. For example, two figures shown in succession may in fact be executed substantially concurrently or may sometimes be executed in the reverse order, depending upon the functionality/acts involved.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art and will not be interpreted in an idealized or overly formal sense unless expressly so defined herein.

Spatially relative terms, such as "beneath", "below", "lower", "above", "upper", and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements described as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors used herein are interpreted accordingly.

Although the terms first, second, etc. may be used herein to describe various elements, components, regions, layers and/or sections, it should be understood that these elements, components, regions, layers and/or sections should not be limited by these terms. These terms are used only to distinguish one element, component, region, layer, or section from another region, layer, or section. Thus, a first element, component, region, layer, or section discussed below could be termed a second element, component, region, layer, or section without departing from the teachings of the present invention.

According to a first embodiment of the invention, a thermo magnetic trip unit for a circuit breaker, in particular for a molded case circuit breaker, comprises a braid plate, a load plate and a heater arranged between the braid plate and the load plate. The braid plate, the load plate and the heater of the thermo magnetic trip unit are building a current path. The thermo magnetic trip unit further comprises a bimetal positioned on the heater, a rotatable trip bar and an energy storage spring. The trip bar can release the energy storage spring after being touched by the bimetal with a certain power. In an embodiment of the thermo magnetic trip unit, the bimetal is an arched or curved snap action bimetal which snaps over to an opposite direction as soon as a certain temperature is reached, whereby the temperature depends on the nominal current flowing to the current path of the thermo magnetic trip unit and whereby the snap action bimetal is formed in such way that in a normal position the snap action bimetal is bent away from the trip bar.

Such thermo magnetic trip unit ensures that the snap action bimetal touches the trip bar with a power that is strong enough to rotate the trip bar if the nominal current flowing to the current path reaches a certain value and a certain temperature in the snap action bimetal is reached.

The snap action bimetal comprises two separate metals joined together. That means the snap action bimetal consists of layers of different metals, especially it is formed of different metal sheets bonded together.

As soon as a certain amount of temperature and nominal current, respectively, is reached, the snap action bimetal snaps over to the opposite direction from which it has been bent rotating the trip bar to release the energy storage spring for opening the electric contacts of a circuit breaker.

According to another preferred development of an embodiment of the invention, a thermo magnetic trip unit can be provided wherein the bimetal is formed in such way that it remains in the normal position if the current that flows through the current path varies from 0% to 105% of the nominal current.

That means if the current that flows through the current path varies from 0% to 105% of the nominal current, the bimetal withstands the temperature changes and remains in the normal position, which is bent to a high expansion side apart from the trip bar.

The bimetal can be formed in such way that it snaps over to the opposite direction if the current that flows through the current path varies from 105% to 120% of the nominal current. Preferred is a thermo magnetic trip unit with a bimetal which is formed in such way that it quickly snaps over to the opposite direction if the current that flows through the current path is reaching 120% of the nominal current.

As soon as the current flow is reaching 120% of the nominal current of the circuit breaker, the temperature on the current path will increase and the bimetal will quickly snap in the direction of the low expansion side, generating enough power to rotate the trip bar.

The snap action bimetal moves from its normal position to the opposite position as soon as the snap action bimetal reaches the calibrated temperature. Then the snap action bimetal generates enough power to rotate the trip bar. Even if the temperature profile on the current path is low, the displacement of the bimetal from its normal position to the opposite position is enough to move the trip bar. New calibration methods can be developed using snap action bimetals in thermo magnetic trip units.

Preferred is a thermo magnetic trip unit, whereby the bimetal is being provided with an electrical conductor which is in direct contact with the bimetal. The electrical conductor forms a part of the heater. Such a bimetal can be heated directly. The reaction time of the bimetal snap action can be reduced substantially. The electrical conductor can have the form of a strip. Further, the electrical conductor can be embedded in an insulating layer positioned on one side of the snap action bimetal.

The electrical conductor provides for an optimal and homogeneous heat transfer to the snap action bimetal so that with an increase in the nominal current flow a fast snap over can be obtained.

According to a second embodiment of the invention, a circuit breaker, in particular a molded case circuit breaker, comprises at least one thermo magnetic trip unit according to an embodiment of the invention. In at least one embodiment, such a circuit breaker ensures that the electric contacts always open if a sufficient overcurrent flows through the circuit breaker's current path. The snap action bimetal guaranties that the power to rotate the trip bar is always high enough if a certain amount of temperature and nominal current is reached.

FIGS. 1 to 4 shows schematically a thermo magnetic trip unit 1 according to the conventional state of the art.

FIGS. 5 to 7 shows schematically in a side view a thermo magnetic trip unit 1 for a circuit breaker, in particular for a molded case circuit breaker, according an embodiment of the invention. The thermo magnetic trip unit 1 comprises a braid plate 2, a load plate 3 and a heater 4 arranged between the braid plate 2 and the load plate 3. The braid plate 2, the load plate 3 and the heater 4 form a current path. The thermo magnetic trip unit 1 further comprises a bimetal 5 arranged at the heater 4, a rotatable trip bar 6 and an energy storage spring 7. The trip bar 6 can release the energy storage spring 7 after being touched by the bimetal 5 with certain power. The bimetal 5 is an arched or curved snap action bimetal 5 which snaps over to an opposite direction if a certain temperature is reached, whereby the temperature depends on the nominal current flowing to the current path. The snap action bimetal 5 is formed in such way that in a normal position the snap action bimetal 5 is bent away from the trip bar 6.

FIG. 6 shows a thermo magnetic trip unit 1 with the snap action bimetal 5 being in the "normal position". In this position the bimetal 5, which can be a strip, is bent away from the trip bar 6, so that there is no contact between the snap action bimetal 5 and the trip bar 6. The snap action bimetal 5 is formed in such way that it remains in the normal position if the current that flows through the current path varies from 0% to 105% of the nominal current. That means if the current that flows through the current path varies from 0% to 105% of the nominal current, the snap action bimetal withstands the temperature changes and remains in the normal position which is bent to a high expansion side apart from the trip par 6, see FIG. 6.

Further the snap action bimetal 5 is formed in such way that it quickly snaps over from the "normal position" or "regular position" into a "releasing position" if the current that flows through the current path reaches 120% of the nominal current, see FIG. 7.

The changeover of the snap action bimetal 5 of the thermo magnetic trip unit 1 is illustrated in FIG. 5. In the "normal position" the snap action bimetal 5 is bent away from the trip par 6. In the "releasing position" the snap action bimetal 5 contacts the trip par 6. Since the snap action bimetal 5 snaps over with a certain velocity the snap action bimetal 5 generates a power which is sufficient to rotate the trip bar 6.

That means if the current flow reaches 120% of the nominal current of the circuit breaker, the temperature on the current path will increase and the snap action bimetal 5 will quickly snap in the direction of the low expansion side, generating enough power to rotate the trip bar 6.

The snap over of the snap action bimetal 5 from its standby "normal" position, see FIGS. 5 and 7, to the activated "releasing" position, see FIGS. 6 and 7, takes place quickly if the snap action bimetal 5 reaches a calibrated temperature. The snap action bimetal 5 generates enough power to rotate the trip bar 6 even if the temperature profile on the current path is low.

Mentioned above are merely example embodiments of the present invention, which are not intended to limit the present invention; and any modifications, equivalent replacements, improvements, etc. made within the spirit and principles of the present invention shall be covered in the protection scope of the present invention.

REFERENCE SIGNS

1 thermo magnetic trip unit
2 braid plate
3 load plate
4 heater
5 bimetal
6 rotatable trip bar
7 energy storage spring
8 heater support plate
9 thermal calibration screw

What is claimed is:

1. Thermo magnetic trip unit for a circuit breaker, comprising:

a braid plate;

a load plate;

a heater arranged between the braid plate and the load plate, the braid plate, the load plate and the heater forming a current path;

a bimetal strip fixed to the heater at a first longitudinal end of the bimetal strip, the bimetal strip being an arched or curved snap action bimetal strip configured to snap over to an opposite direction at a calibrated temperature of the bimetal strip, the temperature being dependent upon a current flowing to the current path;

an energy storage spring; and a rotatable trip bar, configured to release the energy storage spring after being touched by a second longitudinal end of the bimetal strip with certain power, wherein the snap action bimetal strip is formed such that, in a normal position, the second longitudinal end of the snap action bimetal strip is bent away from the trip bar, wherein the bimetal strip is formed such that the bimetal strip remains in the normal position upon the current, flowing through the current path, varying from 0% to 105% of the nominal current.

2. The thermo magnetic trip unit of claim 1, wherein the bimetal strip is formed such that the bimetal strip snaps over to the opposite direction upon the current, flowing through the current path, varying from 105% to 120% of the nominal current.

3. The thermo magnetic trip unit of claim 1, wherein the bimetal strip is formed such that the bimetal strip quickly snaps over to the opposite direction upon the current, flowing through the current path, reaching 120% of the nominal current.

4. A circuit breaker, comprising:

at least one thermo magnetic trip unit of claim 1.

5. The thermo magnetic trip unit of claim 1, wherein the thermo magnetic trip unit is for a molded case circuit breaker.

6. The thermo magnetic trip unit of claim 2, wherein the bimetal strip is formed such that the bimetal strip quickly snaps over to the opposite direction upon the current, flowing through the current path, reaching 120% of the nominal current.

7. The circuit breaker of claim 4, wherein the circuit breaker is a molded case circuit breaker.

8. A circuit breaker, comprising:

at least one thermo magnetic trip unit of claim 2.

9. The thermo magnetic trip unit of claim 1, wherein the energy storage spring is on the rotatable trip bar.

10. The thermo magnetic trip unit of claim 1, wherein the bimetal strip does not include an adjusting screw.

* * * * *